US006784844B1

(12) United States Patent
Boakes et al.

(10) Patent No.: US 6,784,844 B1
(45) Date of Patent: Aug. 31, 2004

(54) ANTENNA ASSEMBLY AND METHOD OF CONSTRUCTION

(75) Inventors: John Boakes, Berkhampstead (GB); Alan Johnson, Camberley (GB); Peter Shead, Winchester (GB)

(73) Assignee: Nokia Mobile Phone Limited, Espoo (FI)

( * ) Notice: Subject to any disclaimer, the term of this patent is extended or adjusted under 35 U.S.C. 154(b) by 0 days.

(21) Appl. No.: 09/684,662

(22) Filed: Oct. 10, 2000

(30) Foreign Application Priority Data

Oct. 8, 1999 (GB) ..... 9923958

(51) Int. Cl.[7] ..... H01Q 1/24; H01Q 1/40
(52) U.S. Cl. ..... 343/702; 343/873
(58) Field of Search ..... 343/702, 873, 343/700 MS, 872, 895; H01Q 1/24, 1/40

(56) References Cited

U.S. PATENT DOCUMENTS

| | | | | |
|---|---|---|---|---|
| 5,363,114 A | * | 11/1994 | Shoemaker | 343/828 |
| 5,574,470 A | | 11/1996 | de Vall | 343/895 |
| 5,709,832 A | * | 1/1998 | Hayes et al. | 343/702 |
| 5,828,342 A | * | 10/1998 | Hayes et al. | 343/702 |
| 5,907,477 A | * | 5/1999 | Tuttle et al. | 343/702 |
| 5,913,174 A | | 6/1999 | Casarez et al. | 455/557 |
| 6,046,708 A | * | 4/2000 | MacDonald, Jr. et al. | 343/906 |
| 6,157,344 A | * | 12/2000 | Bateman et al. | 343/700 MS |
| 6,232,924 B1 | * | 5/2001 | Winstead et al. | 343/702 |
| 6,259,606 B1 | * | 7/2001 | Bunert | 361/737 |
| 6,295,031 B1 | * | 9/2001 | Wallace et al. | 343/702 |

FOREIGN PATENT DOCUMENTS

| | | |
|---|---|---|
| EP | 0903805 | 9/1998 |
| GB | 810814 | 5/1956 |
| GB | 1236372 | 6/1967 |
| GB | 2289163 | 11/1995 |
| JP | 57109 | 1/1993 |
| JP | 10215192 | 8/1998 |
| JP | 1131027 | 2/1999 |
| WO | 9713289 | 4/1997 |
| WO | 9944257 | 9/1999 |

* cited by examiner

*Primary Examiner*—Hoanganh Le
(74) *Attorney, Agent, or Firm*—Antonelli, Terry, Stout & Kraus, LLP

(57) ABSTRACT

An antenna assembly for a telecommunication apparatus is disclosed. The antenna assembly has a conductive element defining a planar antenna and a flexible member arranged to carry the conductive element. A method of encapsulating a planar antenna within a flexible member is also disclosed.

49 Claims, 4 Drawing Sheets

ANTENNA ASSEMBLY AND METHOD OF CONSTRUCTION

BACKGROUND OF THE INVENTION

This invention relates to an antenna assembly, and its method of construction. It is particularly suitable for use with portable telecommunications devices such as portable radio telephones.

Recently, advances in miniaturisation technology have enabled smaller and smaller portable radio telephones to be produced. In particular, more efficient electronics have enabled lower-powered batteries to be used, and in conjunction with improved battery technology, it is now possible to produce portable radio telephones which can easily be carried unobtrusively about the person.

An area of telephone technology which has not benefited so greatly from miniaturisation is antenna design. Generally, an antenna has to be a certain size in order to function adequately. This has made it difficult if not impossible for antennas to shrink at the same rate as other elements of portable radio telephones.

Traditional antenna solutions have taken the form of extendible whip or rod antennas which may be withdrawn from the body of the telephone for use, or helical antennas which are smaller than an extended rod antenna, but which permanently protrude from the telephone.

SUMMARY OF THE INVENTION

According to a first aspect of the present invention, there is provided an antenna assembly for a telecommunication apparatus, comprising: a conductive element defining a planar antenna; and a tapered and tongue-shaped flexible member arranged to carry the conductive element.

According to a second aspect of the present invention, there is provided an antenna assembly for a communication device comprising a tapered and tongue-shaped flexible member carrying a conductive track in a generally planar equilibrium configuration.

Recently, internal planar antennas have become feasible, but as telephones become ever smaller, the effectiveness of the antenna in both transmit and receive modes can be reduced by the antenna being concealed by the user's hand.

Therefore, as the bodies of portable radio telephones become smaller, external antenna assemblies become increasingly out of proportion, and internal antennas cannot function as efficiently.

Advantageously, the present invention enables better antenna performance from a given volume of antenna than other antenna structures such as helices and rod antennas. Being flexible, it is also resistant to damage caused by rough handling.

The antenna element may take several forms. It may be produced by selectively bending and shaping a suitable wire, such as stainless steel or spring steel wire. Alternatively, the antenna pattern may be produced by stamping out a suitable pattern from a planar sheet of steel.

Preferably the antenna element is embedded in the flexible member. This protects the potentially delicate antenna from damage.

The flexible member is preferably tongue-shaped, flat and planar, and the flexible member is configured so that the antenna is held in a generally planar equilibrium. This ensures that the antenna is flexible enough to avoid damage caused by rough handling, but the position is stable so that consistent performance can be attained.

Preferably the antenna is disposed on a substrate. This may be achieved by etching techniques as used to produce PCBs, or by printing the antenna onto the substrate using a conductive ink.

An advantage of carrying the antenna on a substrate is ease of handling, and prevention of damage to the antenna element during subsequent operations.

In order to alleviate the problems of compressive and tensile forces acting on the antenna element when the flexible member bends, it is preferable to dispose the antenna along the midpoint or central bend axis of the flexible member. In this way, the potentially damaging forces have the least effect. This is desirable whether the antenna is disposed on a substrate or not.

In the case when the antenna is disposed on a substrate, it is preferable to sandwich the antenna element between its substrate and another similarly dimensioned piece of substrate material, to ensure that the antenna is disposed on the central bend axis.

In order to maximise the bond between the two halves of the flexible member when a substrate is used, it is preferable to provide one or more apertures in the substrate so that cohesive bonding can occur between the portions of material providing the flexible member. If two layers of substrate are used, then both layers can be perforated.

The antenna assembly preferably comprises a rigid base member to facilitate attachment to a telecommunication apparatus. This base member also provides a means for electrical connection of the antenna.

Some suitable materials for the various parts of the antenna assembly are:

Substrate: Polyester

Flexible member: Thermo plastic elastomer

Rigid Base Member: Glass Filled (10–15%) Polypropylene.

According to a third aspect of the present invention, there is provided a method of producing an antenna assembly comprising the step of: encapsulating a planar antenna element within a flexible member.

Preferably, the antenna is first disposed on a substrate.

Injection moulding techniques are preferably employed to overmould each side of the substrate so that the entire substrate is encapsulated, except for a small portion which allows for electrical connection to the antenna.

Preferably, the overmoulding on each side extends slightly beyond the outer edge of the substrate to ensure that cohesive bonding occurs between the two portions of the flexible member. This advantageously provides a good seal around the antenna assembly.

BRIEF DESCRIPTION OF THE DRAWINGS

For a better understanding of the present invention, and to understand how the same may be brought into effect, reference will now be made to the appended drawings in which.

DETAILED DESCRIPTION OF THE INVENTION

Figure 1:
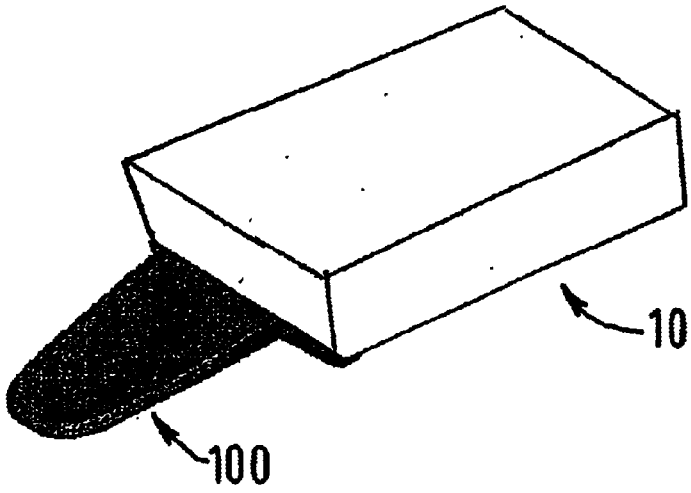
FIG. 1 shows a portable radio telephone incorporating an antenna assembly according to an embodiment of the invention.

An embodiment of an antenna assembly according to the invention In use in a portable radio telephone 10 is shown in FIG. 1. Here the antenna assembly 100 can be seen protruding from the upper surface of the telephone.

The telephone is in all other respects similar to prior art telephones. As previously mentioned, the rapid increase in miniaturisation of portable radio telephones has resulted in devices which are more likely to be carried in pockets than in handbags or briefcases. In the future, so-called wearable telephones may well be designed to be worn on clothing in the manner of a brooch or badge, for instance.

The antenna assembly of the present invention is intended to be generally tongue-shaped, planar, flexible and to protrude from a surface of the telephone 10. This offers advantages in that: it offers increased performance over an internal antenna of similar proportions; and, being flexible, it is less likely to be damaged if the telephone is handled roughly.

In order to construct an antenna assembly according to embodiments of the invention, a suitable antenna design is required. Any number of possible configurations exist, and the actual choice of antenna is dependent on the operating frequency and bandwidth, for instance.

The antenna is planar in that resides on a 2-dimensional surface, as opposed to a rod antenna which can, in many regards, be considered as a 1-dimensional element, or a helical antenna which is defined in terms of 3-dimensions.

Figure 2:
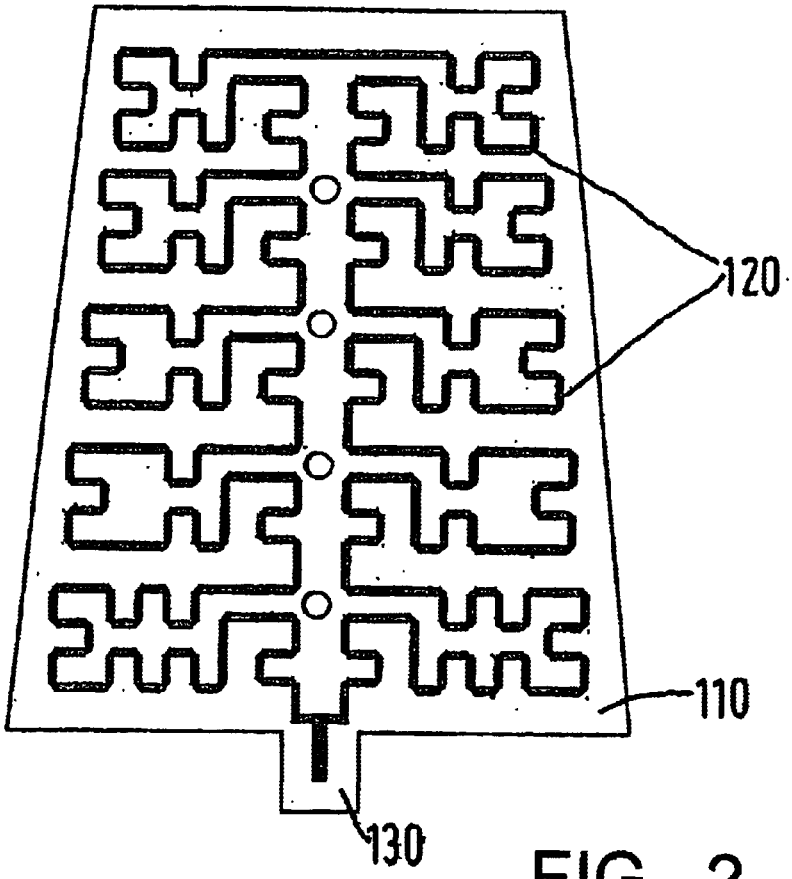
FIG. 2 shows a substrate material on which is disposed an antenna.

FIG. 2 shows an antenna disposed on a substrate. The antenna is produced on a substrate 110, using conventional copper etching techniques which are well known in the art. The substrate 110 is chosen to be flexible. A particularly suitable substrate is polyester. Another suitable substrate is polyamide. The pre-etched substrate consists of a layer of copper, which is adhesively bonded to the polyester substrate. Once the etching is complete, the waste copper has been removed and all that remains is one or more copper tracks or traces defining the antenna design 120 firmly attached to the polyester substrate 110.

As an alternative to etching the antenna out of copper, or other metal, it is also possible to produce the antenna 120 by printing the antenna design, using conductive ink, onto the substrate 110. Etching, however, is presently the preferred solution, as this technology is well proven.

The next stage is the addition of a more rigid material at the base of the antenna assembly to enable it to be fixed to the telephone body. This also serves as a reference point for the next stage of injection moulding. The material chosen for this element has to provide mechanical strength to the base of the antenna assembly. It also has to provide a good bond to the material providing the outer covering of the antenna assembly.

A particularly suitable material for the base is 10–15% Glass Filled Polypropylene. This provides not only the required rigidity, but gives a good bond between the elements which make up the antenna assembly.

To add the base material, the substrate is clamped firmly in position in a mould. Locating holes have previously been provided in the substrate. The base material is then injected into the mould. Once the polypropylene has solidified, the mould is removed, in readiness for the next step.

The rigid base forms a solid bar at the base of the antenna assembly, which extends along its entire width. This provides both stability to the antenna assembly, and means for it to be connected to the telephone.

The small protruding tab 130 at the base of the substrate 110 is left uncovered by the moulding process, as this forms the antenna connection to the transceiver of the telephone 10.

If the antenna assembly were to be used at this stage, it would be very flimsy, and the tracking 120, i.e. the copper traces, would be susceptible to damage. It is therefore desirable to encapsulate the antenna and substrate in a protective material.

Such a material should be durable, flexible and relatively simple to mould around the substrate. A particularly suitable type of material is a Thermo Plastic Elastomer (TPE), e.g. Evoprene. This material is rather rubbery and protects the underlying substrate by both encapsulating it, and thus protecting the traces from scratching, and providing a cushioning effect to protect the antenna assembly from any rough handling.

The process used to form the outer covering is a two-stage injection moulding procedure. Firstly, the substrate and base are securely clamped. A preferred method of securing the part is through use of a vacuum arrangement. Secondly, the mould is introduced over the clamped substrate and securely fastened. Thirdly, the molten TPE material is injected into the mould.

Once the TPE has solidified and cooled, the mould is removed. The antenna and substrate are now completely covered on one side. The process is then repeated to cover and protect the other side of the substrate.

Figure 3:
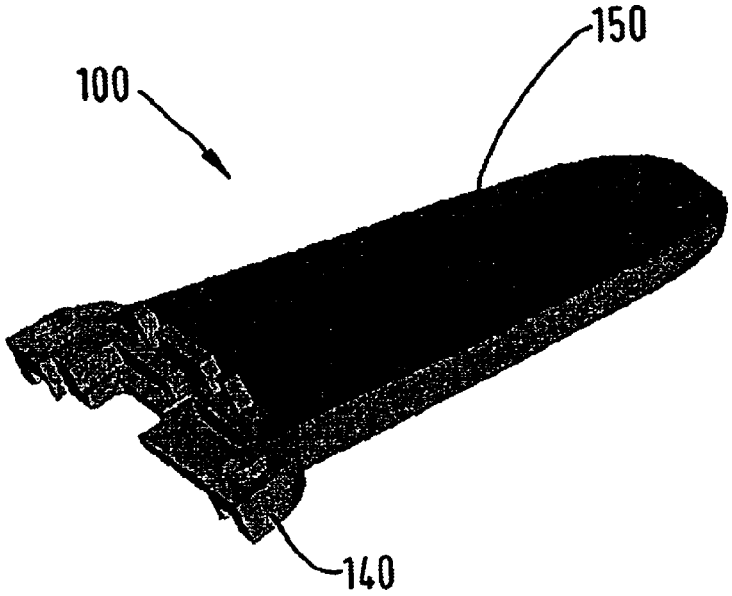
FIG. 3 shows a perspective view of an antenna assembly according to an embodiment of the invention.

FIG. 3 shows the completed antenna assembly, including the rigid base portion 140, and the tongue-shaped flexible antenna portion 150 protruding from it.

Figure 4:
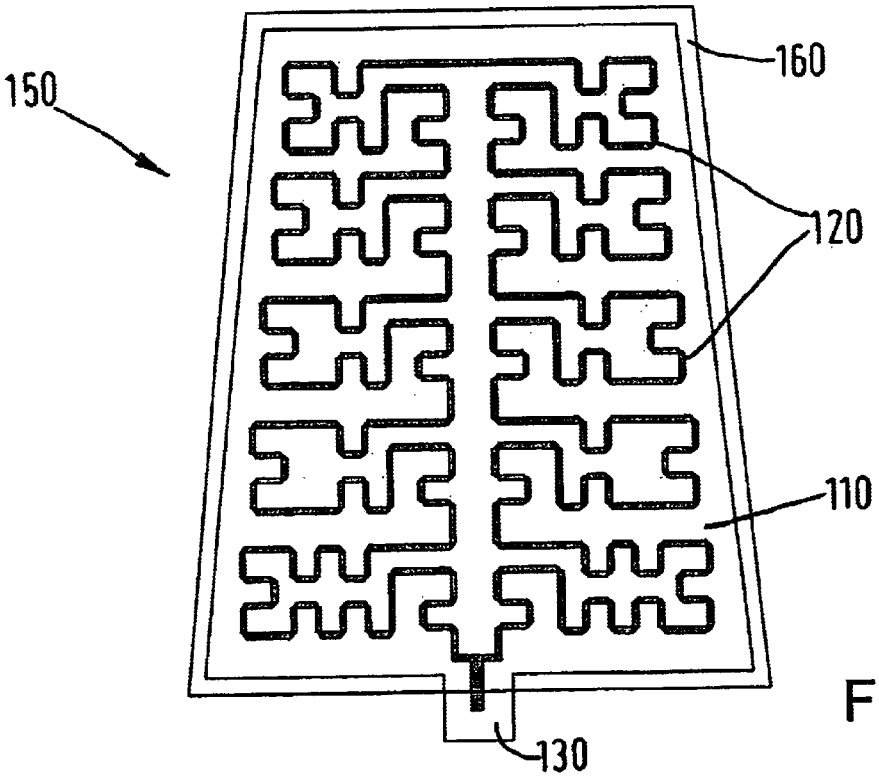
FIG. 4 is a plan view showing some internal features of an antenna assembly according to an embodiment of the invention.

As can be seen in FIG. 4, which shows the flexible part 150 of the antenna assembly and excludes the rigid base portion, the TPE material 160 is moulded to the substrate 110 in such a way that it extends slightly beyond the outer edge, or circumference, of the polyester substrate material. This is performed on both sides of the antenna. This is done to provide a tight seal around the antenna. The cohesive bonding between the TPE 160 on each side is greater than the adhesive bonding between the polyester 110 and the TPE. Even though the bond between TPE and polyester is strong, there may be a tendency for the TPE to peel away from the polyester if the TPE layer ended at the same point as, or inside the circumference of the polyester substrate layer.

Additionally, holes may be provided through the substrate material so that there are points inside the circumference of the substrate where cohesive bonding between the two portions of TPE 160 can occur. These holes should of course be positioned so as not to interfere with the antenna tracking.

FIG. 4 also shows the design of the antenna 120 used in this particular embodiment. In this case, it is a fractal-like antenna, the particular dimensions of which make it suitable for use with a telephone operable according to the Japanese PDC 800 MHz standard. However, any antenna having suitable electrical characteristics may be employed.

The choice of materials can be difficult as they all have different, sometimes conflicting, properties, especially melting point, which makes careful control of the moulding process important.

For instance, the polyester used for the substrate has a lower melting point (90–100° C.) than the other materials which make up the antenna. Unless careful control of the moulding process is exercised, the polyester may be prone to damage when the polypropylene or TPE, which have higher melting points (130° C. and 120–130° C. respectively), is moulded onto the substrate material. It is found that careful control of the moulding process, particularly the temperature of the injected TPE ensures that the polyester is undamaged. Polyester has other benefits which make its use desirable in this application. In particular, polyester is transparent, whereas polyamide, an alternative substrate, is opaque, and the transparency of the substrate is used to aesthetic effect in the finished product.

In particular, the TPE layers may be configured to have a non-uniform thickness. This allows a portion of the TPE to be moulded such that the antenna tracking is visible through the otherwise opaque TPE layer.

An advantage of this three stage moulding process is that there are no 'finishing' operations required in order to make the antenna assembly ready for use. For instance, an alternative technique, common in moulding, is to provide tabs which are used to locate a part in a mould. After moulding, these superfluous tabs need to be removed. In the case of the antenna assembly discussed above, such tabs would by necessity have to protrude from the edges of the polyester substrate, and would interfere with the seal provided by the cohesive bonding of the two layers of TPE. The process described above requires more time in the moulding activity, but saves time overall, as no finishing is required.

Figure 5:
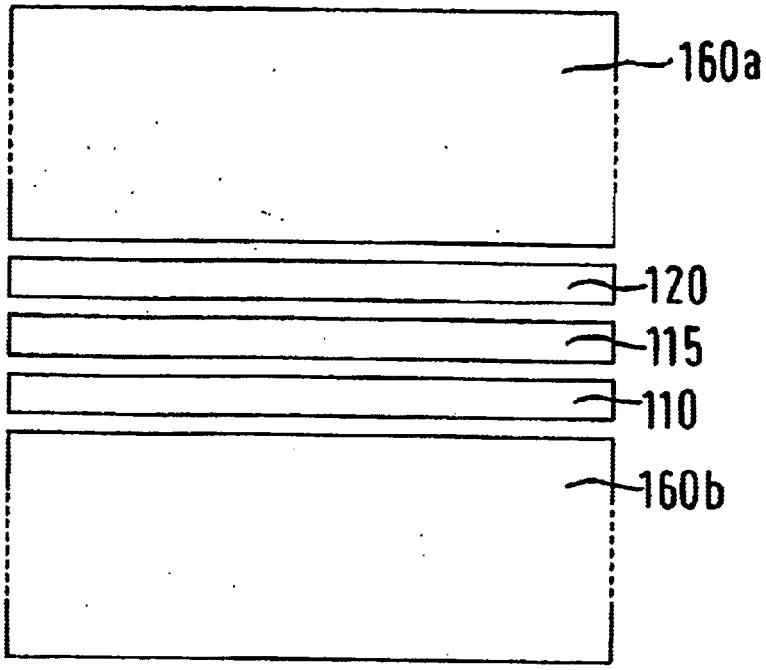
FIG. 5 shows an exploded cross-sectional view of an antenna assembly is, according to a first embodiment of the invention.

FIG. 5 shows an exploded cross-sectional view of the flexible parts 150 of the antenna assembly 100. The substrate 110 and copper layers 120 can be seen to be securely protected within the two layers of TPE 160. The approximate thicknesses of the layers are:

Substrate 110: 25–50 $\mu$m

Adhesive 115: 15–25 $\mu$m

Copper 120: 35 $\mu$m (1 oz)

TPE 160: 0.5–1.2 mm

Although the configuration of FIG. 5 provides good protection of the copper tracking 120 from scratching, this particular structure can cause other problems for the copper tracking.

Imagine the antenna assembly of FIG. 5 flexing. As it bends, the lower layer of TPE 160*b* will be in compression, and the upper layer of TPE 160*a* will be in tension. This is the same for all the intermediate layers, depending on whether they are on one side or the other of the central bend axis. This poses problems for the copper layer 120, where, with repeated flexing, the copper tracking will be subjected to repeated compressive and tensile stresses. Over a cycle of many such flexes, there is a possibility that the copper tracking will become cracked, severely affecting the antenna performance, or in the worst case, rendering it useless.

One way to solve this problem is through careful control of the thicknesses of the various other layers, particularly the TPE layer 160. However, this level of control introduces further problems into the manufacturing process and makes it needlessly complex.

Figure 6:
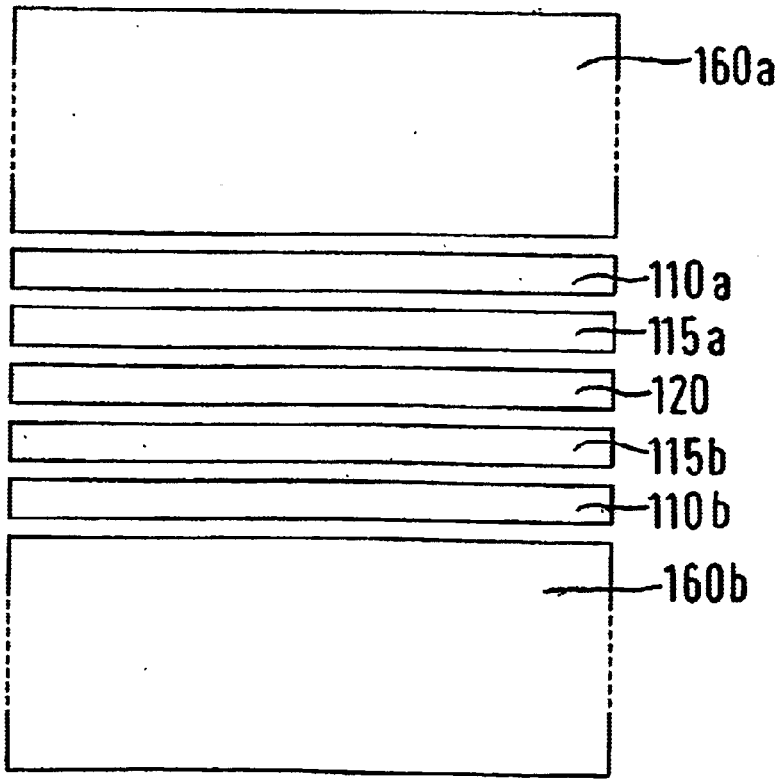
FIG. 6 shows an exploded cross-sectional view of an antenna assembly according to a second embodiment of the invention.

A preferred solution is the introduction of a further layer of polyester substrate material 110*b*. This is as shown in FIG. 6. Once the etched copper substrate 110*a*, 115*a*, 120 is produced as previously described, a controlled amount of adhesive 115*b* is added to the copper surface 120, followed by a layer of polyester 110*b* similar in dimensions to the original substrate layer 110*a*. The entire assembly is then rolled under heat and pressure to securely bond the layers together. The copper tracking 120 is now securely fixed between two similar layers of polyester substrate 11*a*, 110*b*. The injection moulding of the rigid base portion 140 and the two TPE 160 layers can then proceed as before.

This configuration, as seen in FIG. 6, ensures that the copper tracking 120 is on the central bend axis, and also that it is surrounded by two layers having identical mechanical properties. Any flexing of the antenna 150 means that the copper tracking 120 is less likely to be subject to potentially damaging tensile or compressive forces.

As described previously, perforatons may be provided in the two layers of polyester to assist the bonding between the two external layers of TPE 160.

Once the antenna assembly is complete, it can be introduced into the telephone assembly. The antenna assembly is secured by the moulded rigid base portion 140. This is configured to have one or more apertures which coincide with corresponding apertures and structures in other parts of the telephone. Once aligned, screws are used to secure the parts together.

The tab 130 which was left exposed in the earlier moulding processes is used to connect the antenna 100 to the transceiver portion of the telephone. Contact is achieved through the use of a sprung clip which automatically connects as the assembly is screwed together. The clip is positioned within the casing of the telephone such that it contacts the tab 130 when the antenna is secured in position. It is electrically connected to the input/output port of the transceiver. Other connections methods, such as soldering or provision of plugs and sockets could be used instead.

Once assembled, the antenna assembly does not detract significantly from the aesthetic appeal of the telephone, and may even augment it.

An alternative to the use of an etched or printed antenna is the use of a formed wire, or stamped antenna patter. In this case, no substrate is required.

The antenna may be formed by shaping a fairly rigid wire to form the desired antenna pattern. Stainless steel or spring steel are suitable materials. Alternatively, it may be stamped out of a suitable conductive sheet using a custom tool. Again, stainless steel or spring steel are suitable materials. Either method will produce a free antenna, i.e. an antenna with no substrate, which may be used in much the same way as the substrate-based antenna previously described.

Figure 7:
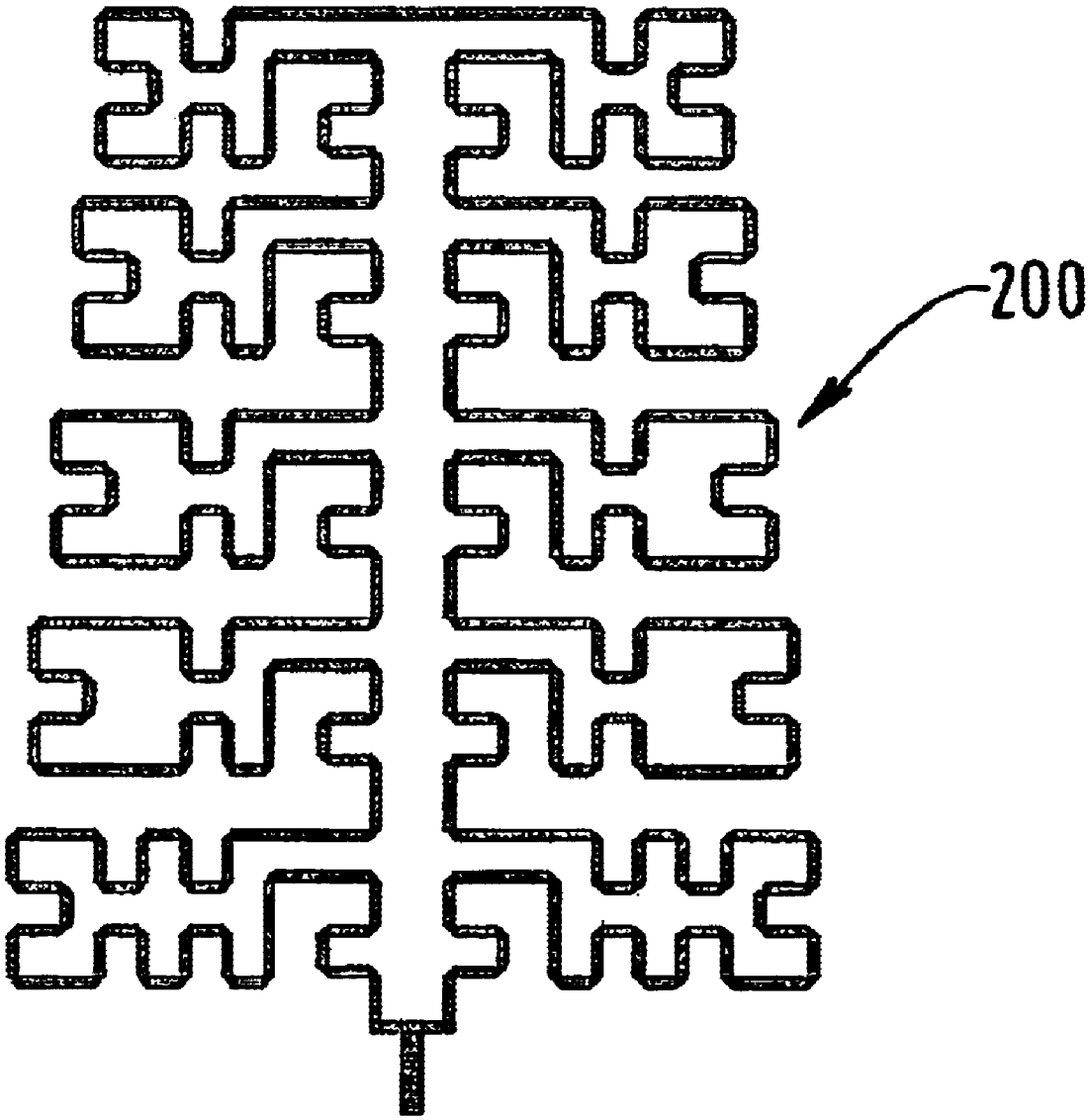
FIG. 7 shows an alternative antenna element according an alternative embodiment of the invention.

FIG. 7 shows an antenna 200 produced by one of the above methods. It is clear that it is very similar to the antennas previously described which rely on a substrate, and its electrical characteristics can be controlled so that it operates identically.

One method of producing the antenna assembly around such an antenna element requires pre-moulded TPE material equivalent to one portion 160 of the previously described antenna assembly. The antenna element is then positioned to rest on what will form the inner part of the assembly before the second half of the TPE is injection moulded as previously described.

An alternative method of producing the assembly would be to use a one shot moulding process in which the antenna element is positioned inside a mould before molten TPE is injected to enclose it. This method requires careful positioning of the antenna element within the mould if the previously described problems of compressive and tensile stresses are to be avoided.

In either case, the rigid base member 140 may be added as a further moulding stage, or its function may be performed by a further piece of the telephone assembly.

In view of the foregoing description it will be evident to a person skilled in the art that various modifications may be made within the scope of the invention. In particular, different materials may be selected which still achieve the desired effects. Also, the function served by the rigid base portion 140 could be provided by a non-integral part of the antenna.

The present invention includes any novel feature or combination of features disclosed herein either explicitly or any generalisation thereof irrespective of whether or not it relates to the claimed invention or mitigates any or all of the problems addressed.

What is claimed is:

1. An assembly comprising:

a conductive element defining a planar antenna which is permanently external to a housing of a handheld telecommunication apparatus; and a generally flat and planar flexible member arranged to carry the conductive element and to protrude and be disposed permanently in a fixed position from and relative to a surface of the housing of the handheld telecommunication apparatus; and wherein the member tapers in width from the fixed position to an end of the member and the member is flexible in use of the assembly.

2. An assembly as claimed in claim 1 wherein the conductive element is embedded in the flexible member.

3. An assembly as claimed in claim 2, wherein the conductive element is a pre-formed wire.

4. An assembly as claimed in claim 2, wherein the conductive member is a stamped out pattern from a planar sheet.

5. An assembly as claimed in claim 2, wherein the conductive element is disposed on a substrate.

6. An assembly as claimed in claim 5, wherein the conductive element is disposed on the substrate by a process of etching.

7. An assembly as claimed in claim 5, wherein the conductive element is disposed on the substrate by a process of printing using conductive ink.

8. An assembly as claimed in claim 5, wherein the substrate is polyester.

9. An assembly as claimed in claim 5, wherein the substrate is polyamide.

10. An assembly as claimed in 5 wherein the substrate material comprises an aperture.

11. An antenna as claimed in claim 10, wherein the conductive element is disposed on the substrate by a process of etching.

12. An assembly as claimed in claim 10, wherein the conductive element is disposed on the substrate by a process of printing using conductive ink.

13. An assembly as claimed in claim 10, wherein the substrate is polyester.

14. An assembly as claimed in claim 10, wherein the substrate is polymide.

15. An assembly as claimed in 5 wherein the conductive element is disposed between the substrate and a second substrate material.

16. An assembly as claimed in claim 15, wherein the conductive element is disposed on the substrate by a process of etching.

17. An assembly as claimed in claim 15, wherein the conductive element is disposed on the substrate by a process of printing using conductive ink.

18. An assembly as claimed in claim 15, wherein the substrate is polyester.

19. An assembly as claimed in claim 15, wherein the substrate is polyamide.

20. An assembly as claimed in claim 1, wherein the conductive element is disposed on a central bend axis of the flexible member.

21. An assembly as claimed in claim 20, wherein the conductive element is a pre-formed wire.

22. An assembly as claimed in claim 20, wherein the conductive member is a stamped out pattern from a planar sheet.

23. An assembly as claimed in claim 1, wherein the flexible member is biased towards a generally planar equilibrium.

24. An assembly as claimed in claim 23, wherein the conductive element is disposed on the substrate by a process of etching.

25. An assembly as claimed in claim 23, wherein the conductive element is disposed on the substrate by a process of printing using conductive ink.

26. An assembly as claimed in claim 23, wherein the substrate is polyester.

27. An assembly as claimed in claim 23, wherein the substrate is polyamide.

28. An assembly as claimed in claim 1, wherein the assembly further comprises a relatively rigid base portion for connecting the assembly to the handheld telecommunication apparatus.

29. An assembly as claimed in claim 28 wherein the rigid base portion is 10–15% glass filled polypropylene.

30. An assembly as claimed in claim 28, wherein the conductive element is disposed on the substrate by a process of etching.

31. An assembly as claimed in claim 28, wherein the conductive element is disposed on the substrate by a process of printing using conductive ink.

32. An assembly as claimed in claim 28, wherein the substrate is polyester.

33. An assembly as claimed in claim 28, wherein the substrate is polyamide.

34. An assembly as claimed in claim 1, wherein the conductive element is a pre-formed wire.

35. An assembly as claimed in claim 34, wherein the conductive element is stainless steel or spring steel.

36. An assembly as claimed in claim 1, wherein the conductive member is a stamped out pattern from a planar sheet.

37. An assembly as claimed in claim 36, wherein the conductive element is stainless steel or spring steel.

38. An assembly as claimed in claim 1, wherein the flexible member is a thermo plastic elastomer.

39. A method of producing an antenna assembly comprising the steps of:

arranging a planar antenna element to be disposed on a substrate; and encapsulating the planar antenna element within a generally flat and planar, flexible member by means of an injection moulding process; and wherein the member longitudinally tapers in width.

40. A method as claimed in claim 39 wherein the flexible member is produced by moulding operations performed on opposing sides of the substrate.

41. A method as claimed in claim 40 wherein the moulding on each side extends beyond the outer edge of the substrate.

42. A method as claimed in claim 41, wherein holes are provided through the substrate inside the circumference of the substrate.

43. A method as claimed in claim 42, wherein cohesive bonding between the moulding on each side occurs through said holes.

44. A method as claimed in claim 41, wherein the substrate is made of transparent polyester and the moulding on each side has a non-uniform thickness of a thermo plastic elastomer.

45. A method as claimed in claim 44, wherein the temperature of the thermo plastic elastomer is controlled during the injection moulding process to avoid damage to the polyester substrate.

46. A method in accordance with claim 39 wherein:

the assembly is an external antenna for a handheld telecommunications apparatus.

47. A handheld telecommunication apparatus comprising:

a planar antenna disposed on a substrate which is permanently external to a housing of the handheld apparatus; and a generally flat and planar, flexible member encapsulating the planar antenna and the substrate, said flexible member coupling said antenna to the handheld apparatus and being arranged to protrude and be disposed permanently in a fixed position from and relative to a surface of the housing of the handheld telecommunication apparatus; and wherein the member tapers in width from the fixed position to an end of the member and is flexible in use of the apparatus.

48. A handheld telecommunications apparatus as claimed in claim 47, wherein said flexible member includes moulding on each side of said substrate, said moulding extending beyond the outer edge of said substrate.

49. An antenna assembly for a handheld telecommunication apparatus comprising:

a conductive element defining a planar antenna; and a generally flat and planar flexible member arranged to carry the conductive element and arranged to protrude and to be permanently external to and to be permanently in a fixed position from and relative to a surface of a housing of the handheld communication apparatus; and wherein the member tapers in width from the fixed position to an end of the member and the member is flexible in use of the assembly.

* * * * *